US010229779B2

(12) United States Patent
Harber

(10) Patent No.: US 10,229,779 B2
(45) Date of Patent: Mar. 12, 2019

(54) EMBEDDED MAGNETIC COMPONENT DEVICE

(71) Applicant: Murata Manufacturing Co., Ltd., Nagaokakyo-shi, Kyoto-fu (JP)

(72) Inventor: Jamie Harber, Milton Keynes (GB)

(73) Assignee: MURATA MANUFACTURING CO., LTD., Kyoto (JP)

( * ) Notice: Subject to any disclaimer, the term of this patent is extended or adjusted under 35 U.S.C. 154(b) by 0 days.

(21) Appl. No.: 15/050,536

(22) Filed: Feb. 23, 2016

(65) Prior Publication Data

US 2016/0254091 A1 Sep. 1, 2016

(30) Foreign Application Priority Data

Feb. 26, 2015 (GB) ..... 1503265.9

(51) Int. Cl.
*H01F 27/28* (2006.01)
*H01F 27/26* (2006.01)
*H01F 41/04* (2006.01)

(52) U.S. Cl.
CPC ..... *H01F 27/266* (2013.01); *H01F 27/2804* (2013.01); *H01F 27/2895* (2013.01); *H01F 41/046* (2013.01)

(58) Field of Classification Search
CPC ..... H01F 17/06; H01F 17/062; H01F 30/16; H01F 41/08
USPC ..... 336/200, 229, 232
See application file for complete search history.

(56) References Cited

U.S. PATENT DOCUMENTS 5,959,846 A * 9/1999 Noguchi ..... H01F 17/0033 257/690
6,188,305 B1 * 2/2001 Chang ..... H01F 17/0033 336/200
2002/0037434 A1 3/2002 Feygenson et al.
2003/0025585 A1 * 2/2003 Macerini ..... H01F 27/2804 336/65
2011/0291789 A1 * 12/2011 Dalmia ..... H01F 17/0006 336/200
2013/0104365 A1 5/2013 Huang et al.
(Continued)

FOREIGN PATENT DOCUMENTS

CN 102316675 A 1/2012
EP 2 779 810 A2 9/2014

OTHER PUBLICATIONS

Kneller et al.; "Embedded Magnetic Component Device"; U.S. Appl. No. 14/825,332, filed Aug. 13, 2015.
(Continued)

*Primary Examiner* — Tszfung J Chan
(74) *Attorney, Agent, or Firm* — Keating & Bennett, LLP

(57) ABSTRACT

In a method of manufacturing an embedded magnetic component, a cavity is formed in an insulating substrate. One or more drops of adhesive are applied to the cavity and a magnetic core is inserted in the cavity. The cavity and the magnetic core are then covered with a first insulating layer. Through holes are formed through the first insulating layer and the insulating substrate, and plated up to form conductive vias. Metallic traces are added to exterior surfaces of the first insulating layer and the insulating substrate to form upper and lower winding layers. The metallic traces and the conductive vias form the windings for an embedded magnetic component, such as a transformer or an inductor.

13 Claims, 10 Drawing Sheets

(56) References Cited

U.S. PATENT DOCUMENTS

| | | | | |
|---|---|---|---|---|
| 2014/0043130 | A1 | 2/2014 | Dalmia et al. | |
| 2014/0093643 | A1* | 4/2014 | Li | B05C 5/0216 427/238 |
| 2014/0116758 | A1* | 5/2014 | Li | H05K 1/165 174/255 |
| 2015/0061817 | A1* | 3/2015 | Lee | H01F 17/0013 336/221 |

OTHER PUBLICATIONS

Parish et al.; "Embedded Magnetic Component Device"; U.S. Appl. No. 14/825,327, filed Aug. 13, 2015.
Francis; "Embedded Magnetic Component Device"; U.S. Appl. No. 14/883,854, filed Oct. 15, 2015.
Wang et al.; "Embedded Magnetic Component Transformer Device"; U.S. Appl. No. 14/883,855, filed Oct. 15, 2015.
Kneller; "Embedded Magnetic Component Transformer Device"; U.S. Appl. No. 14/883,859, filed Oct. 15, 2015.
Kneller; "Embedded Magnetic Component Transformer Device"; U.S. Appl. No. 14/883,863, filed Oct. 15, 2015.
Wang et al.; "Embedded Magnetic Component Transformer Device"; U.S. Appl. No. 14/883,866, filed Oct. 15, 2015.
Kneller et al.; "Embedded Magnetic Component Transformer"; U.S. Appl. No. 15/019,240, filed Feb. 9, 2016.
Parish et al.; "Embedded Magnetic Component Device"; U.S. Appl. No. 15/054,412, filed Feb. 26, 2016.
Lloyd; "Embedded Magnetic Component"; U.S. Appl. No. 15/049,414, filed Feb. 22, 2016.
Kneller et al., "Multi-Tap Winding Design For Embedded Transformer", U.S. Appl. No. 15/498,765, filed Apr. 27, 2017.
Francis, "Power Electronics Device With Improved Isolation Performance", U.S. Appl. No. 15/498,769, filed Apr. 27, 2017.
Kneller et al., "DC-DC Converter Device", U.S. Appl. No. 15/703,086, filed Sep. 13, 2017.
Official Communication issued in Great Britian Patent Application No. GB1503265.9, dated Apr. 24, 2018.

* cited by examiner

EMBEDDED MAGNETIC COMPONENT DEVICE

BACKGROUND OF THE INVENTION

1. Field of the Invention

The present invention relates to embedded magnetic components, and in particular, to embedded magnetic components with improved isolation performance.

2. Description of the Related Art

Power supply devices, such as transformers and converters, involve magnetic components such as transformer windings and often magnetic cores. The magnetic components typically contribute the most to the weight and size of the device, making miniaturization and cost reduction difficult.

In addressing this problem, it is known to provide low profile transformers and inductors in which the magnetic components are embedded in a cavity in a resin substrate, and the necessary input and output electrical connections for the transformer or inductor are formed on the substrate surface. A printed circuit board (PCB) for a power supply device can then be formed by adding layers of solder resist and copper plating to the top and/or bottom surfaces of the substrate. The necessary electronic components for the device may then be surface mounted on the PCB. This allows a significantly more compact and thinner device to be built.

In US2011/0108317, for example, a packaged structure including a magnetic component that can be integrated into a printed circuit board, and a method for producing the packaged structure, are described. In a first method, illustrated in FIGS. 1A to 1E, an insulating substrate 101, made of epoxy based glass fiber, has a cavity 102 (FIG. 1A). An elongate toroidal magnetic core 103 is inserted into the cavity 102 (FIG. 1B), and the cavity is filled with an epoxy gel 104 (FIG. 1C) so that the magnetic component 103 is fully covered. The epoxy gel 104 is then cured, forming a solid substrate 105 including an embedded magnetic core 103.

Through-holes 106 for forming primary and secondary side transformer windings are then drilled in the solid substrate 105 on the inside and outside circumferences of the toroidal magnetic component 103 (FIG. 1D). The through-holes are then plated with copper, to form vias 107, and metallic traces 108 are formed on the top and bottom surfaces of the solid substrate 105 to connect respective vias together into a winding configuration (FIG. 1E) and to form input and output terminals 109. In this way, a coil conductor is created around the magnetic component. The coil conductor shown in FIG. 1E is for an embedded transformer and has left and right coils forming primary and secondary side windings. Embedded inductors can be formed in the same way, but may vary in terms of the input and output connections, the spacing of the vias, and the type of magnetic core used.

A solder resist layer can then be added to the top and bottom surfaces of the substrate covering the metallic surface terminal lines, allowing further electronic components to be mounted on the solder resist layer. In the case of power supply converter devices, for example, one or more as transistor switching devices and associated control electronics, such as Integrated Circuit (ICs) and Operational Amplifiers (Op Amps) may be mounted on the surface resist layer.

Devices manufactured in this way have a number of associated problems. In particular, air bubbles may form in the epoxy gel as it is solidifying. During reflow soldering of the electronic components on the surface of the substrate, these air bubbles can expand and cause failure in the device.

US2011/0108317 also describes a second technique in which epoxy gel is not used to fill the cavity. This second technique will be described with respect to FIGS. 2A to 2F.

As illustrated in FIG. 2A, through-holes 202 are first drilled into a solid resin substrate 201 at locations corresponding to the interior and exterior circumference of an elongate toroidal magnetic core. The through-holes 202 are then plated up to form the vertical conductive vias 203 of the transformer windings, and metallic caps 204 are formed on the top and the bottom of the conductive vias 203 as shown in FIG. 2B. A toroidal cavity 205 for the magnetic core is then routed in the solid resin substrate 201 between the conductive vias 203 (FIG. 2C), and an elongate toroidal magnetic core 206 is placed in the cavity 205 (FIG. 2D). The cavity 205 is slightly larger than the magnetic core 206, and an air gap may therefore exist around the magnetic core 206.

Once the magnetic core 206 has been inserted into the cavity 205, an upper epoxy dielectric layer 207 (such as an adhesive bondply layer) is added to the top of the structure, to cover the cavity 205 and the magnetic core 206. A corresponding layer 207 is also added to the bottom of the structure (FIG. 2E) on the base of the substrate 201. Further through-holes are drilled through the upper and lower epoxy layers 207 to the caps 204 of the conductive vias 203, and plated, and metallic traces 208 are subsequently formed on the top and bottom surfaces of the device as before (FIG. 2F).

As noted above, where the embedded magnetic components of FIGS. 1A-1E and 2A-2F are transformers, a first set of windings 110, 210 provided on one side of the toroidal magnetic core form the primary transformer coil, and a second set of windings 112, 212 on the opposite side of the magnetic core form the secondary windings. Transformers of this kind can be used in power supply devices, such as isolated DC-DC converters, in which isolation between the primary and secondary side windings is required. In the example devices illustrated in FIGS. 1A-1E and 2A-2F, the isolation is a measure of the minimum spacing between the primary and secondary windings.

In the case of FIGS. 1A-1E and 2A-2F above, the spacing between the primary and secondary side windings must be large to achieve a high isolation value, because the isolation is only limited by the dielectric strength of the air, in this case in the cavity or at the top and bottom surfaces of the device. The isolation value may also be adversely affected by contamination of the cavity or the surface with dirt.

For many products, safety agency approval is required to certify the isolation characteristics. If the required isolation distance through air is large, there will be a negative impact on product size. For mains reinforced voltages (250 Vms), for example, a spacing of approximately 5 mm is required across a PCB from the primary windings to the secondary windings in order to meet the insulation requirements of EN/UL60950.

The inventors of the invention described and claimed in the present application discovered that it would be desirable to provide an embedded magnetic component device with improved isolation characteristics, and to provide a method for manufacturing such a device.

SUMMARY OF THE INVENTION

In a first aspect of various preferred embodiments of the present invention, a method of manufacturing an embedded magnetic component device including a magnetic core embedded in a cavity formed in an insulating substrate and one or more electrical windings formed around the magnetic core, includes: a) preparing a base insulating substrate including a cavity for the magnetic core, the cavity including a cavity floor and side walls connected by the cavity floor; b) applying one or more spots of adhesive to discrete locations inside the cavity or on the magnetic core to form one or more adhesive coated attachment points for the magnetic core; c) installing the magnetic core in the cavity; d) applying a cover layer to the base insulating substrate to cover the magnetic core and the cavity so as to obtain an insulated substrate; e) forming one or more electrical windings, passing through at least the insulating substrate adjacent the cavity and disposed around the magnetic core, and wherein the magnetic core is secured in the cavity by the one or more discrete adhesive coated attachment points.

The method may further include forming the cavity to be slightly larger than the magnetic core such that when the magnetic core is installed in the cavity, an air gap remains between the magnetic core and the cavity side walls, and/or between the magnetic core and the insulating layer.

The method may further include maintaining the air gap to be free of adhesive between the magnetic core and the side walls of the cavity, and/or between the magnetic core and the insulating layer.

The cavity and the magnetic core may be toroidal and the method may further include positioning the one or more discrete adhesive coated attachment points at discrete locations spaced around the toroid on the cavity floor.

The method may further include forming a channel connecting the cavity to the exterior of the insulated substrate, the channel including a channel floor connecting to the cavity floor.

The method may further include positioning at least one of the adhesive coated attachment points at the intersection where the channel meets the cavity.

The method may further include: forming a first and second channel connecting the cavity to the exterior of the insulated substrate, the first and second channels including channel floors connecting to the cavity floor, and located on opposite sides of the cavity, wherein the one or more discrete adhesive coated attachment points include a first adhesive coated attachment point located at the intersection where the first channel meets the cavity; a second adhesive coated attachment point located at the intersection where the second channel meets the cavity; and third and/or fourth adhesive coated attachment points located in the cavity at respective locations intermediate the intersections where the first and second channels meet the cavity.

The cavity has a circumference and the method may further include spacing the first, second, third and/or fourth adhesive coated attachment points apart from one another equally or substantially equally around the circumference of the cavity.

The spots of adhesive may be located on the cavity floor only.

The method may further include forming the electrical windings as isolated primary and secondary electrical windings, passing through at least the insulated substrate and the insulating layer and disposed around first and second sections of the magnetic core.

The method may further include locating the adhesive coated attachment points in a non-contacting relationship to the electrical windings.

In a second aspect of preferred embodiments of the present invention, an embedded magnetic component device includes: a base insulating substrate including opposing first side and second sides, and including a cavity therein, the cavity including a cavity floor, and cavity side walls connected by the cavity floor; a magnetic core housed in the cavity; an insulating layer applied on the base insulating substrate covering the magnetic core and the cavity so as to define an insulated substrate; one or more electrical windings, passing through at least the insulated substrate adjacent the cavity and disposed around the magnetic core; and one or more discrete adhesive coated attachment points which secure the magnetic core in the cavity, the adhesive coated attachment points provided on the cavity or on the magnetic core.

The cavity may be slightly larger than the magnetic core such that when the magnetic core is installed in the cavity, and air gap remains between the magnetic core and the cavity side walls, and/or between the magnetic core and the insulating layer.

The cavity and the magnetic core may be toroidal and the one or more discrete adhesive coated attachment points may be positioned at discrete locations spaced around the toroid on the cavity floor.

The device may further include a channel connecting the cavity to the exterior of the insulated substrate, the channel including a channel floor connecting to the cavity floor.

At least one of the adhesive coated attachment points may be located at the intersection where the channel meets the cavity.

The device may further include: a first and second channel connecting the cavity to the exterior of the insulated substrate, the first and second channels including channel floors connected to the cavity floor, and located on opposite sides of the cavity, wherein the one or more discrete adhesive coated attachment points include: a first adhesive coated attachment point located at the intersection where the first channel meets the cavity; a second adhesive coated attachment point located at the intersection where the second channel meets the cavity; and third and/or fourth adhesive coated attachment points located in the cavity at respective locations intermediate the intersections where the first and second channels meet the cavity.

The cavity has a circumference and the first, second, third and/or fourth adhesive coated attachment points may be spaced apart from one another equally or substantially equally around the circumference of the cavity.

The adhesive coated attachment points may be located on the cavity floor only.

The electrical windings may include isolated primary and secondary electrical windings, passing through at least the insulated substrate and the insulating layer and disposed around first and second sections of the magnetic core.

The adhesive coated attachment points may be located in non-contacting relationship to the electrical windings.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred Embodiment 1

A first example preferred embodiment of an embedded magnetic component device will now be described with reference to FIGS. 3A to 3G. A completed embedded magnetic component device according to the first example preferred embodiment of the present invention is illustrated in FIG. 3G.

The left and right sides of FIGS. 3A to 3G are schematic and intended only to illustrate the general composition of the device to the reader. The right sides of FIGS. 3A to 3G show an elevation view of the top of the device as it is formed. The left sides of FIGS. 3A to 3G show a cross-section through the device intended to show the main components of the device. However, for clarity, some details have been omitted, and the plane of the cross-section modified. Where relevant this will be pointed out below.

Figure 1A:
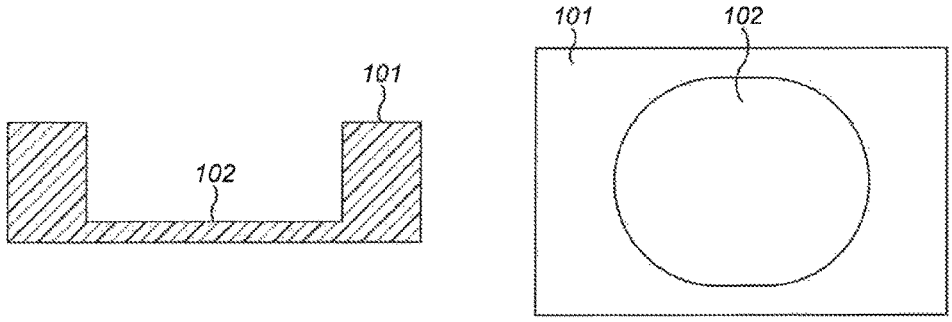
FIG. 1A (Prior Art)
FIG. 1A to 1E illustrate a first known technique for manufacturing a substrate including an embedded magnetic component
Figure 1B:
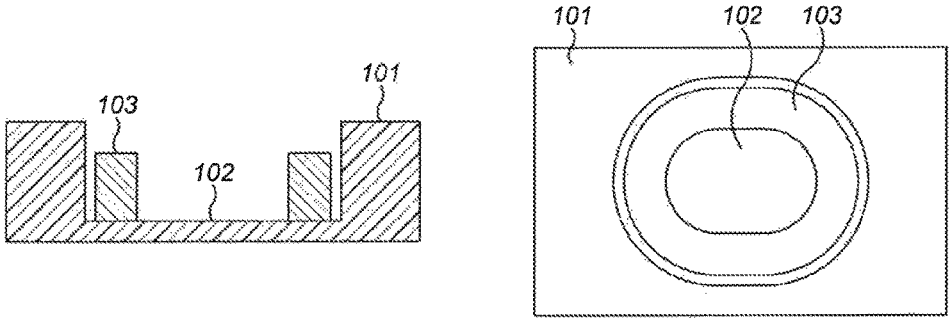
FIG. 1B (Prior Art)
Figure 1C:
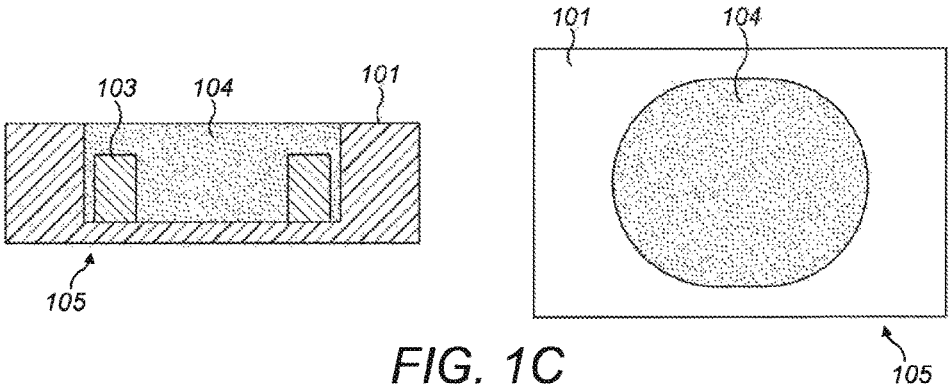
FIG. 1C (Prior Art)
Figure 1D:
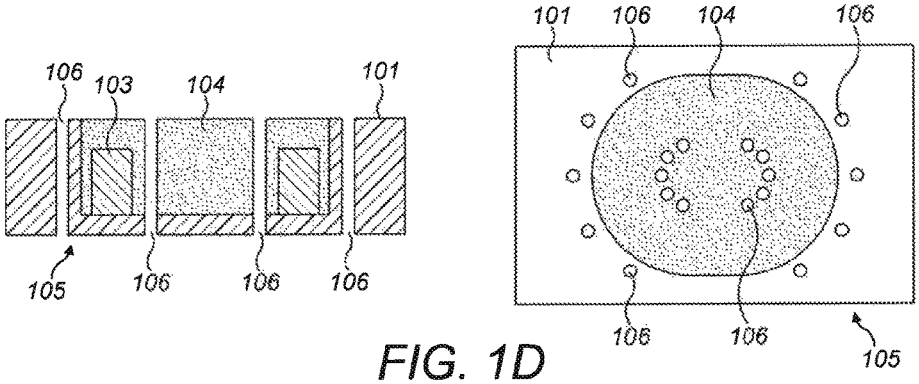
FIG. 1D (Prior Art)
Figure 1E:
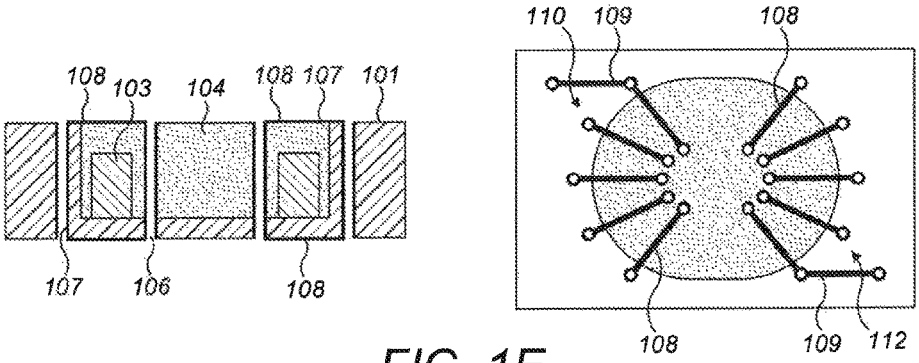
FIG. 1E (Prior Art)
Figure 2A:
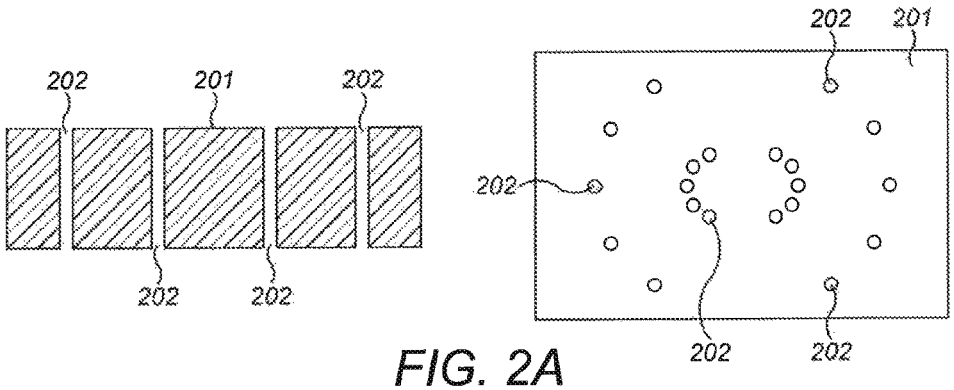
FIG. 2A (Prior Art)
FIG. 2A to 2F illustrate a second known technique for manufacturing a substrate including an embedded magnetic component.
Figure 2B:
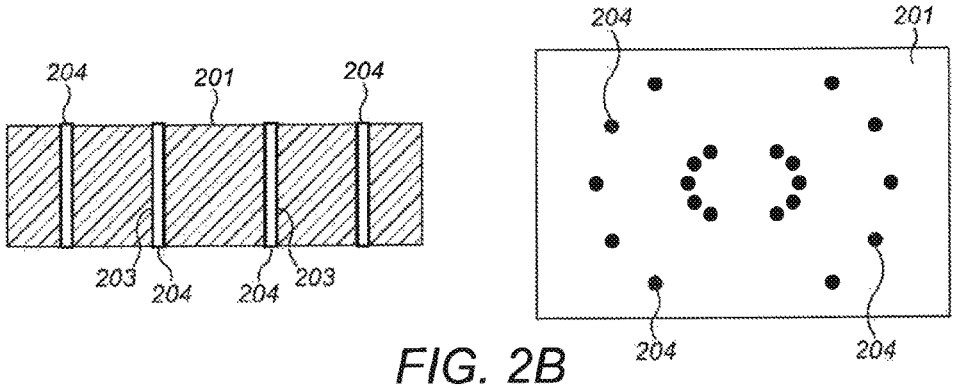
FIG. 2B (Prior Art)
Figure 2C:
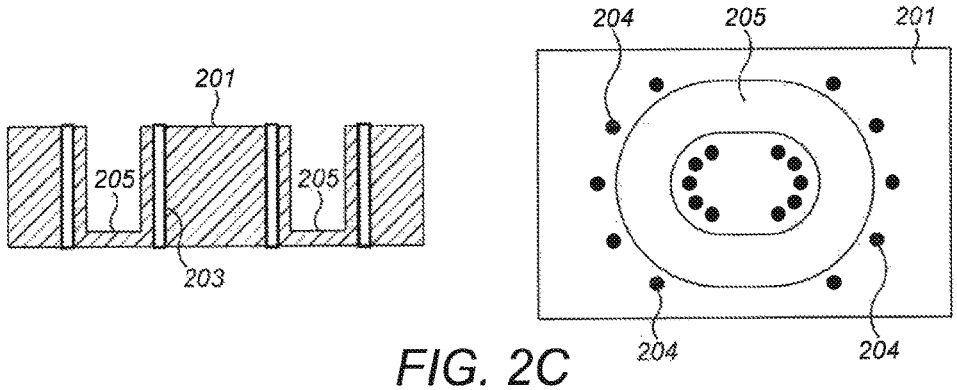
FIG. 2C (Prior Art)
Figure 2D:
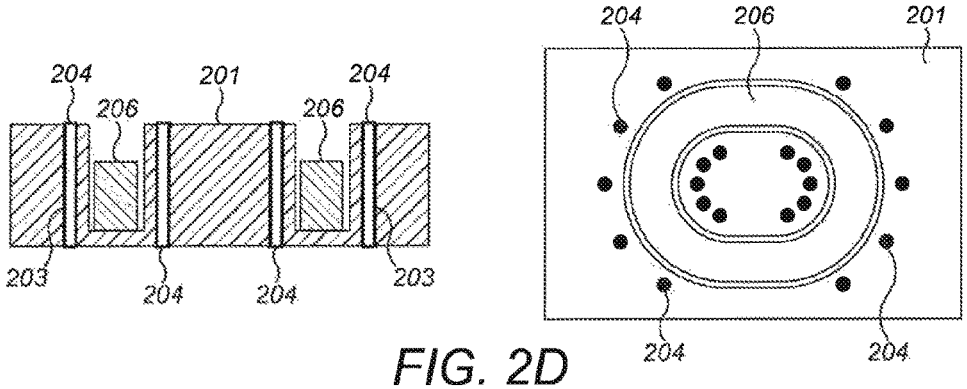
FIG. 2D (Prior Art)
Figure 2E:
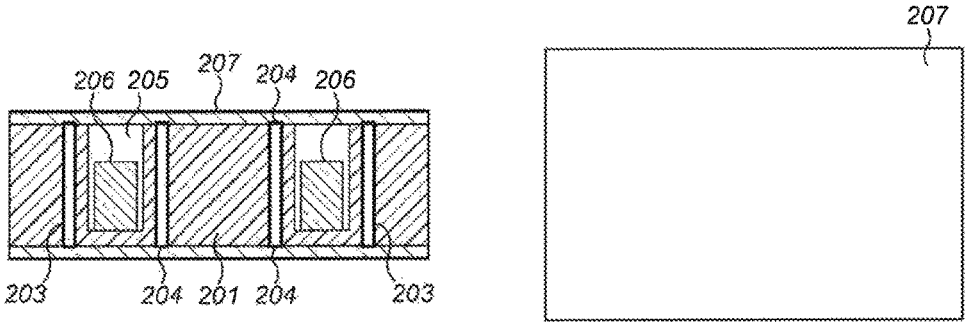
FIG. 2E (Prior Art)
Figure 2F:
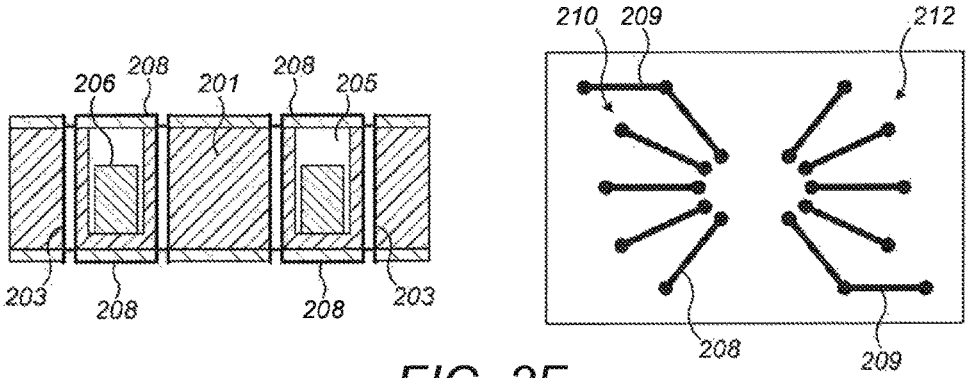
FIG. 2F (Prior Art)
Figure 3A:
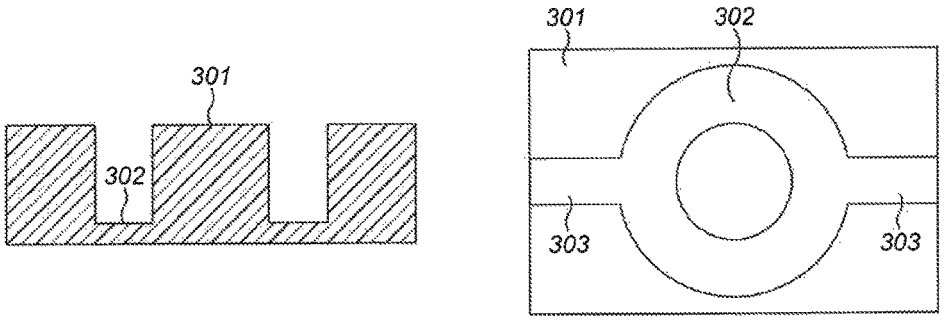
FIG. 3A to 3G show a technique for manufacturing a device according to a first preferred embodiment of the present invention.

In a first step, illustrated in FIG. 3A, a circular annulus or cavity 302 that houses a magnetic core is routed or otherwise formed in a base insulating substrate 301. In this example, the base insulating substrate is formed of a resin material, such as FR4. FR4 is a composite 'pre-preg' material composed of woven fiberglass cloth impregnated with an epoxy resin binder. The resin is pre-dried, but not hardened, so that when it is heated, it flows and acts as an adhesive for the fiberglass material. FR4 has been found to have favorable thermal and insulation properties.

The cavity may also have one or more channels 303 formed between the circular cavity 302 and the outside edges of the substrate 301. These channels may be formed by the router bit as it begins and concludes the routing process for the circular cavity 302. In the case of a single channel, the router bit may therefore enter and leave the substrate 301 via the same channel 303. In alternative preferred embodiments, the circular cavity 302 and channels 303 may be formed by building up resin layers in such a shape that the cavity and channels are formed. The channels are not illustrated the left sides of FIGS. 3A to 3G for the sake of clarity, but are visible on the elevation view on the right sides.

Figure 3B:
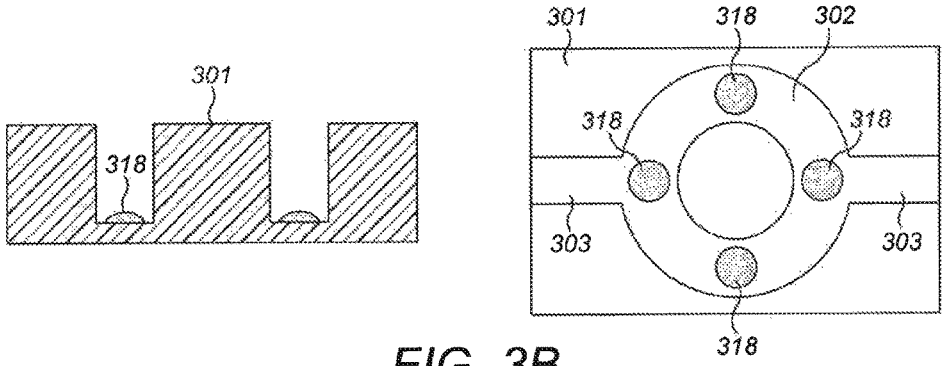

As illustrated in FIG. 3B, one or more drops of adhesive 318 are then applied to the base of the cavity 302. In FIG. 3B, four drops of adhesive are shown, for example, located at the four cardinal positions (e.g. north, south, east and west sides) of the cavity 302. The adhesive may be applied by hand, or more preferably, by automated process, such as an X-Y gluing system. The adhesive may be any suitable silicon or epoxy based adhesive for example. Although four spots of adhesive are shown in FIG. 3B, one or more drops may be used. The location of the adhesive spots in the cavity 302 is illustrated in more detail in FIG. 5A and discussed below.

Figure 3C:
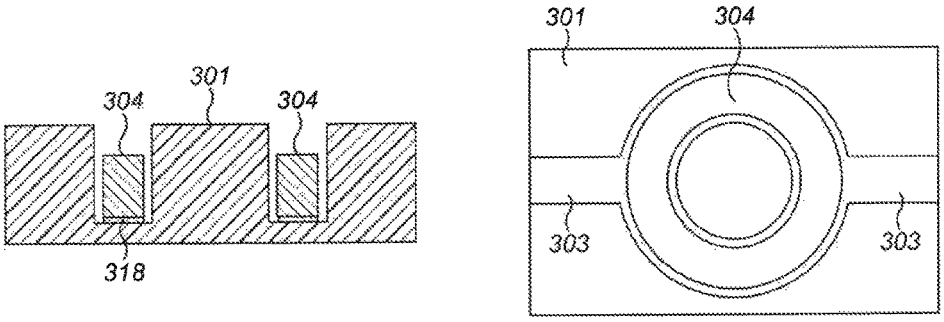

As shown in FIG. 3C, a circular magnetic core 304 is then installed in the cavity 302. The cavity 302 may be slightly larger than the magnetic core 206, so that an air gap may exist around the magnetic core 304. The magnetic core 304 may be installed in the cavity manually or by a surface mounting device such as a pick and place machine. The magnetic core 304 is located on the spots of adhesive so that a secure bond will be formed between the magnetic core 304 and the cavity 302. Where the adhesive is a heat activated adhesive, a curing step of the adhesive may be carried out immediately, or later together with the steps for forming subsequent layers on the device (such as in connection with the step of FIG. 3D below).

Figure 3D:
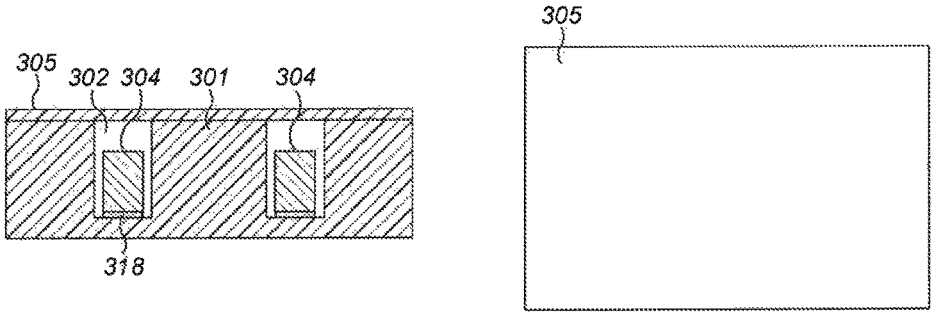

In the next step, illustrated in FIG. 3D, a first insulating layer 305 is secured or laminated on the insulating substrate 301 to cover the cavity 302 and magnetic core 304 and form an insulated substrate. Preferably, the first insulating layer 305 is formed of the same material as the insulating substrate 301 as this aids bonding between the top surface of the insulating substrate 301 and the lower surface of the first insulating layer 305. The first insulating layer 305 may therefore also be formed of a material such as FR4, laminated onto the insulating substrate 301. Lamination may be via adhesive or via heat activated bonding between layers of pre-preg material. In other preferred embodiments, other materials may be used for the layer 305.

Figure 3E:
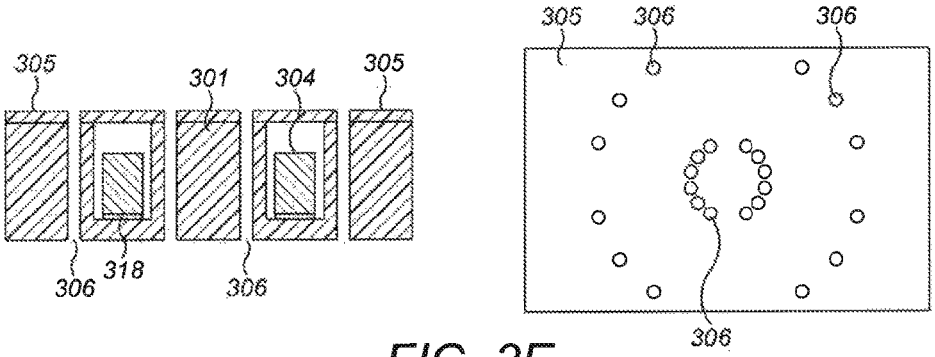

In the next step illustrated in FIG. 3E through-holes 306 are formed through the insulating substrate 301 and the first insulating layer 305. The through holes 306 are formed at suitable locations to form the primary and secondary coil conductor windings of an embedded transformer. In this example preferred embodiment, as the transformer includes the magnetic core 304 that is round or circular in shape, the through holes are therefore suitably formed along sections of two arcs corresponding to inner and outer circular circumferences. As is known in the art, the through-holes 306 may be formed by drilling, or other suitable technique. Due to the presence of the channels 303, the through holes are not formed at the 3 o'clock and 9 o'clock positions around the circular magnetic core, as this would put the through holes in the channel 303 itself. Instead, the through holes are arranged to avoid the channel. The cross-section illustrated on the left sides of FIGS. 3A to 3G is arranged to show the through-holes 306. As a result of following a cross-section plane in which the through-holes 306 are visible, however the channels 303 are not visible. A schematic illustration of an example pattern of conductive vias is shown in FIG. 4 and described below.

Figure 3F:
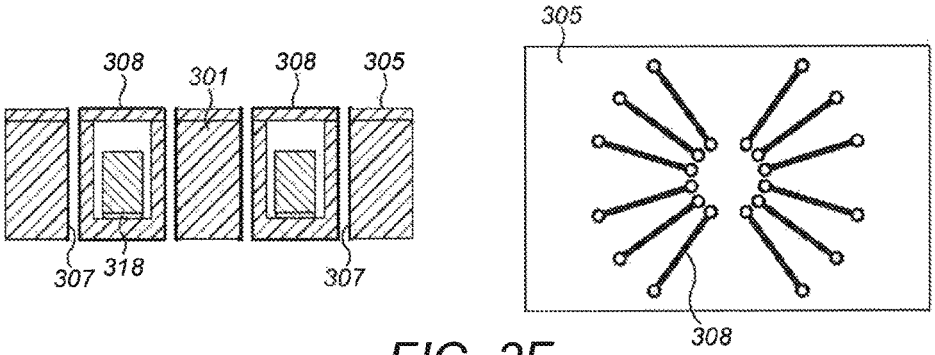
Figure 3G:
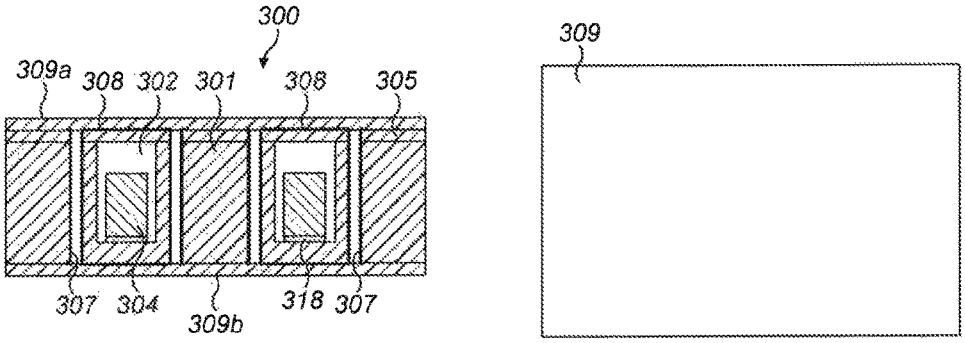
Figure 4:
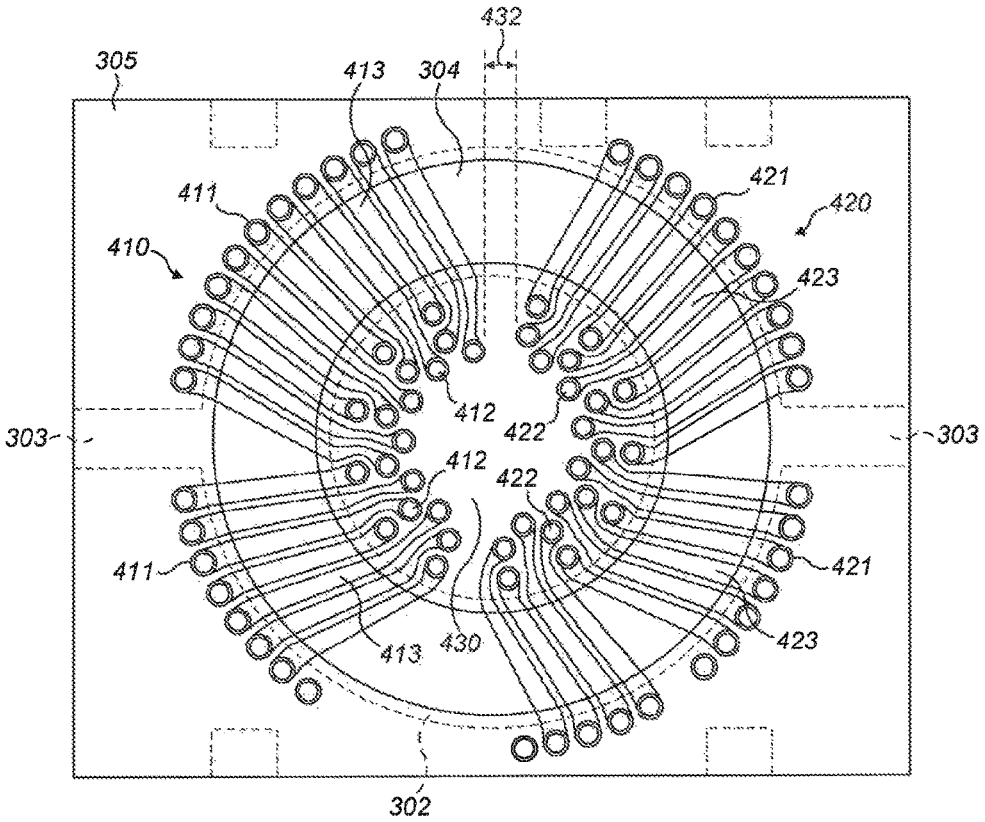
FIG. 4 illustrates a top down view of the cavity, the magnetic core, and the conductive vias.

As shown in FIG. 3F, the through-holes 306 are then plated up to form conductive via holes 307 that extend from the top surface of the first insulating layer to the bottom surface of the substrate 301. Conductive or metallic traces 308 are added to the top surface of the first insulating layer 305 to form an upper winding layer connecting the respective conductive via holes 307, and partially forming the windings of the transformer. The upper winding layer is illustrated by way of example in the right side of FIG. 3F. The metallic traces 308 and the plating for the conductive vias are usually formed from copper, and may be formed in any suitable way, such as by adding a copper conductor layer to the outer surfaces of the layer 305 which is then etched to form the necessary patterns, deposition of the copper onto the surface, and so on.

Metallic traces 308 are also formed on the bottom surface of the insulating substrate 301 to form a lower winding layer also connecting the respective conductive via holes 307 to partially form the windings of the transformer. The upper and lower winding layers 308 and the via holes 307 together form the primary and secondary windings of the transformer.

Lastly, as shown in FIG. 3G, second and third further insulating layers 309 are formed on the top and bottom surfaces of the structure shown in FIG. 3F. The layers may be secured in place by lamination or other suitable technique. The bottom surface of the second insulating layer 309*a* adheres to the top surface of the first insulating layer and covers the terminal lines 308 of the upper winding layer. The top surface of the third insulating layer 309*b* on the other hand adheres to the bottom surface of the substrate 301 and so covers the terminal lines 308 of the lower winding layer. Advantageously, the second and third layers may also be formed of FR4, and so laminated onto the insulating substrate 301 and first insulating layer 305 using the same process as for the first insulating layer 305.

Through holes and via conductors are formed through the second and third insulating layers in order to connect to the input and output terminals of the primary and second transformer windings (not shown). Where the vias through the second and third insulating layers are located apart from the vias through the substrate and the first insulating layer 305, a metallic trace will be needed on the upper winding layer connecting the input and output vias to the first and last via in each of the primary and secondary windings. Where the input and output vias are formed in overlapping positions, then conductive or metallic caps could be added to the first and last via in each of the primary and secondary windings.

The pattern of through holes 306, conductive vias 307 and metallic traces 308 forming the upper and lower winding layers of the transformer will now be described in more detail with reference to FIG. 4. FIG. 4 is a top view of the embedded magnetic component device with the upper winding layer exposed. The primary windings 410 of the transformer are shown on the left side of the device, and the secondary windings 420 of the transformer are shown on the right side. One or more tertiary or auxiliary transformer windings may also be formed, using the conductive vias 307 and metallic traces 308 but are not illustrated here. In FIG. 4, input and output connections to the transformer windings are also omitted to avoid obscuring the detail.

The primary winding of the transformer 410 includes outer conductive vias 411 arranged around the outer periphery of the circular cavity 302 containing the magnetic core 304. As illustrated here, the outer conductive vias 411 closely follow the outer circumference or periphery of the cavity 302 and are arranged in a row, along a section of arc on both sides of the left most channel 303.

Inner conductive vias 412 are provided in the inner or central region of the substrate, and are arranged in rows adjacent the inner circumference of the cavity 302 containing the magnetic core 304. Owing to the smaller radius circumscribed by the inner cavity wall compared to the outer cavity wall, there is less space to arrange the inner conductive vias 412 compared to the outer conductive vias 411. As a result, the inner conductive vias 412 are staggered and arranged broadly in two or more rows including different radius. Some of the inner conductive vias 412 in the primary winding are therefore located closer to the wall of the cavity 302 than the other inner conductive vias 412, which are located closer to the central part of the device. In FIG. 4, the inner conductive vias can be seen to be arranged in three rows, for example.

Each outer conductive via 411 in the upper winding layer 308 is connected to a single inner conductive via 412 by a metallic trace 413. The metallic traces 413 are formed on the surface of the first insulating layer 305 and so cannot overlap with one another. Although, the inner conductive vias need not strictly be arranged in rows, it is helpful to do so, as an ordered arrangement of the inner conductive vias 412 assists in arranging the metallic traces 413 so that they connect the outer conductive vias 411 to the inner conductive vias 412.

The secondary winding of the transformer 420 also includes outer conductive vias 421, and inner conductive vias 422 connected to each other by respective metallic traces 423 in the same way as for the primary winding.

The lower winding layer 308 of the transformer is arranged in the same way. The conductive vias are arranged in identical or complementary locations to those in the upper winding layers. However, in the lower winding layer 308 the metallic traces 413, 423 are formed to connect each outer conductive via 411, 421 to an inner conductive via 412, 422 adjacent to the inner conductive via 412, 422 to which it was connected in the upper winding layer. In this way, the outer 411, 421 and inner conductive vias 421, 422, and the metallic traces 413, 423 on the upper and lower winding layers 308 form coiled conductors around the magnetic core 304. It will be appreciated that the number of conductive vias allocated to each of the primary and secondary windings determines the winding ratio of the transformer.

In an isolated DC-DC converter, for example, the primary winding 410 and the secondary winding 412 of the transformer must be sufficiently isolated from one another. In FIG. 4, the central region of the substrate, the region circumscribed by the inner wall of the cavity 302, forms an isolation region 430 between the primary and the secondary windings. The minimum distance between the inner conductive vias 412 and 422 of the primary and secondary windings 410 and 420 is the insulation distance, and is illustrated in FIG. 4 by arrow 432.

Figure 5A:
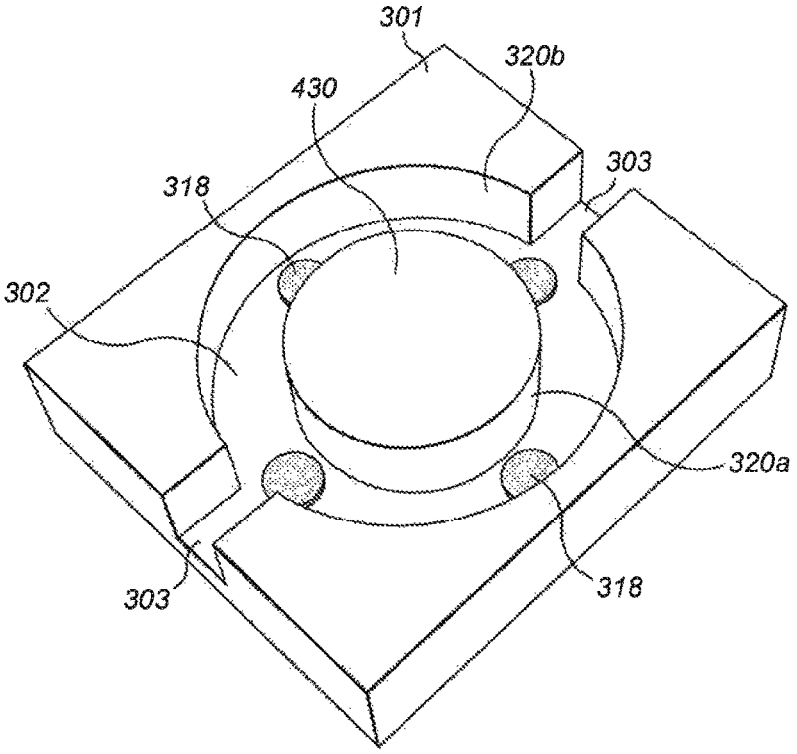
FIG. 5A is an isometric view of the cavity showing the adhesive applied in FIG. 3B.
Figure 5B:
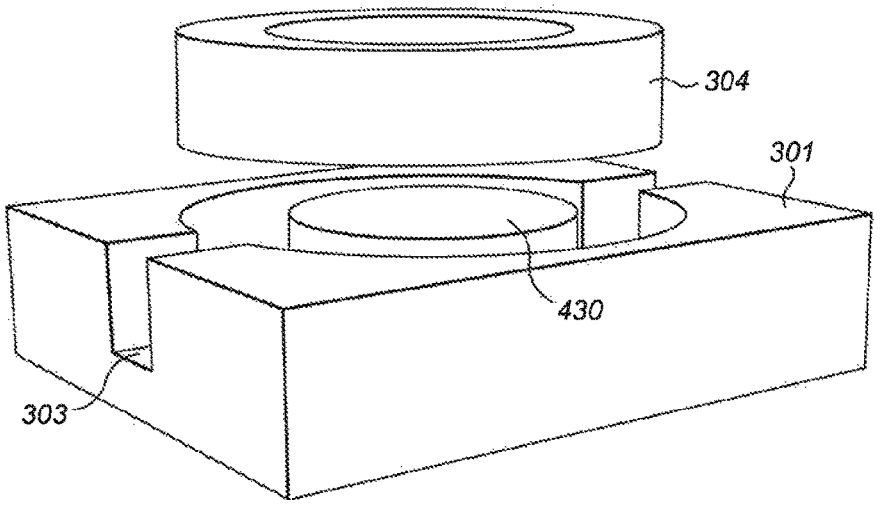
FIG. 5B is an isometric view of the installation of the magnetic core as shown in FIG. 3C.

FIGS. 5A and 5B, to which reference should now be made, show further details of FIGS. 3B and 3C in isometric view. As mentioned above in connection with FIGS. 3B and 3C, the magnetic core 304 is preferably secured by at least one drop of adhesive 318 applied to the bottom of the cavity 302. When the magnetic core is put in position in the cavity 302 and the adhesive hardens the bottom surface of the magnetic core 304 is therefore securely adhered to the cavity 302. This prevents movement of the magnetic core and means that the magnetic core 304 is protected from mechanical shocks and/or vibration damage that might otherwise occur during manufacture, transport or a customer application.

The use of adhesive 318 also means that the magnetic core 304 is able to be reliably positioned in the cavity 302, ensuring a consistent air gap between the core 304 and the cavity walls 320*a* and 320*b*. This improves the precision with which the embedded component devices can be manufactured, thus reducing device failure rates, and including a positive impact on the ability of the device to satisfy externally applied safety ratings or requirements.

As shown in FIG. 5A, preferably four spots or drops of adhesive are used, one located at each of the four cardinal positions (e.g. north, south, east, west) around the central isolation region 430, for example. The spots of adhesive 318 form adhesive coated attachment points for mounting of the magnetic core 304 in later steps such as that shown in FIG. 5B. There should always be sufficient separation between gluing spots so that they are distinct from one another, as this allows the adhesive some space to expand before it hardens, such as before or during the curing process, and so aids with distribution of the adhesive around the base of the magnetic core.

The presence of the channels 303 and the fact that the adhesive 318 is applied only to one side of the magnetic core means that air can flow into and out of the cavity 302 during the subsequent stages of production. As a result, there is a considerable reduction of possible voids causing damage to the device during later reflow soldering stages of manufacture. Furthermore, when the component is complete, the channels 303 and air gap in the cavity 302 aids with cooling of the device during operation.

The equal separation of adhesive 318 around the base of the cavity and, the bottom surface of the magnetic core 304 (when it is installed in the cavity 302), also distributes any potential stress to the magnetic core 304 equally or substantially equally around its circumference, and any potential stress to the substrate 301 equally or substantially equally across the surface area of the cavity 302. The separation of the attachment points formed by the spots of adhesive also for expansion and contraction of the core and substrate interface during thermal cycling, thus reducing the risk of stress and cracks forming in the core.

Furthermore, the use of spots of adhesive reduces possible magnetic restriction of the ferrite core. Contact between the adhesive and the core can have an effect on the inductance of the core. Thus, if the amount of glue touching the core is reduced, the inductance is increased.

Furthermore, the technique avoids the need to fully encapsulate the magnetic core 304 inside the cavity 302, such as in the known art illustrated in FIGS. 1A-1E. As described earlier, it is not possible to guarantee when encapsulating the magnetic core that the resulting solid material will be free of voids. Any voids remaining in the material when the device is reflow soldered can expand and lead to device failure. Fully encapsulated products have also been found to present concerns with moisture.

In other preferred embodiments, one or more gluing points may however be used around the base of the core, and around the sides of the magnetic core 304 and the side cavity walls 320*a* and 320*b*. In alternative preferred embodiments, the adhesive 318 may be applied to the magnetic core 304 only, so that when the core 304 is lowered into the cavity (in FIG. 5B, for example) it can be secured as before.

Features of the embedded component device described above provide a number of further advantages. The second and third insulating layers 309*a* and 309*b* form a solid bonded joint with the adjacent layers, either layer 305 or substrate 301, on which the upper or lower winding layers 308 of the transformer are formed. The second and third insulating layers 309*a* and 309*b* therefore provide a solid insulated boundary along the surfaces of the embedded magnetic component device, greatly reducing the chance of arcing or breakdown, and allowing the isolation spacing between the primary and secondary side windings to be greatly reduced.

To meet the insulation requirements of EN/UL60950 only 0.4 mm is required through a solid insulator for mains referenced voltages (250 Vrms).

The second and third insulating layers 309*a* and 309*b* are formed on the substrate 301 and first insulating layer 305 without any air gap remaining between the layers. It will be appreciated that if there is an air gap in the device, such as above or below the winding layers, then would be a risk of arcing and failure of the device. The second and third insulating layers 309*a* and 309*b*, the first insulating layer 305 and the substrate 301, therefore form a solid block of insulating material.

In the prior art illustrated by FIGS. 1A-1E and 2A-2F for example, the distance between the primary side and secondary side windings is about 5 mm. Due to the second and the third insulating layers provided in the present preferred embodiment, the distance 432 between the primary and secondary side is able to be reduced to about 0.4 mm allowing significantly smaller devices to be produced, as well as devices with a higher number of transformer windings. In this context, the spacing between the primary and secondary windings can be measured as the distance between the closest conductive vias in the primary side 411,412, and the secondary side 421,422, and/or between their associated metallic traces.

The second and third layers need only be on the top and bottom of the device in the central region between the primary and secondary windings. However, in practice it is advantageous to make the second and third insulating layers cover the same area as that of the first layer 305 and substrate 301 on which they are formed. As will be described below, this provides a support layer for a mounting board on top, and provides additional insulation between the components on that board, and the transformer windings underneath.

The preferred thickness of the extra insulating layers 309 may depend on the safety approval required for the device as well as the expected operating conditions. For example, FR4 has a dielectric strength of around 750V per mil (0.0254 mm), and if the associated magnitude of the electric field used in an electric field strength test were to be 3000V say, such as that which might be prescribed by the UL60950-1 standard, a minimum thickness of about 0.102 mm would be required for layers 309*a* and 309*b*, for example. The thickness of the second and third insulating layers could be greater than this, subject to the desired dimensions of the final device. Similarly, for test voltages of 1500V and 2000V, the minimum thickness of the second and third layers, if formed of FR4 would be about 0.051 mm and about 0.068 mm respectively, for example.

Although solder resist may be added to the exterior surfaces of the second and third insulating layers, this is optional in view of the insulation provided by the layers themselves.

Although in the example described above, the substrate 301 and additional insulating layers 305, 309 are made of FR4, any suitable PCB laminate system including a sufficient dielectric strength to provide the desired insulation may be included. Non-limiting examples include FR4-08, G11, and FR5.

As well as the insulating properties of the materials themselves, the additional insulating layers 305 and 309 must bond well with the substrate 301 to form a solid bonded joint. The term "solid bonded joint" means a solid consistent bonded joint or interface between two materials with little voiding. Such a solid bonded joint should keep its integrity after relevant environmental conditions, for example, high or low temperature, thermal shock, humidity and so on. It should be noted that well-known solder resist layers on PCB substrates cannot form such a "solid bonded joint" and therefore the insulating layers 305 and 309 are different from such solder resist layers.

For this reason, the material for the extra layers is preferably the same as the substrate as this improves bonding between them. The layers 305, 309 and substrate 301 could however be made of different materials providing there is sufficient bonding between them to form a solid bonded joint. Any material chosen would also need to have good thermal cycling properties so as not to crack during use and would preferably be hydrophobic so that water would not affect the properties of the device.

In other preferred embodiments, the insulating substrate 301 could be formed from other insulating materials, such as ceramics, thermoplastics, and epoxies. These may be formed as a solid block with the magnetic core embedded inside. As before, first, second and third insulating layers 305, and 309 would then be laminated onto the substrate 301 to provide the additional insulation.

The magnetic core 304 is preferably a ferrite core as this provides the device with the desired inductance. Other types of magnetic materials, and even air cores, which are unfilled cavities formed between the windings of the transformer, are also possible in alternative preferred embodiments. Although, in the examples above, the magnetic core is circular in shape, it may have a different shape in other preferred embodiments. Non-limiting examples include, an oval or elongate toroidal shape, a toroidal shape including a gap, EE, EI, I, EFD, EP, UI and UR core shapes. In the present example, a round core shape was found to be the most robust leading to lower failure rates for the device during production. The magnetic core 304 may be coated with an insulating material to reduce the possibility of breakdown occurring between the conductive magnetic core and the conductive vias 307 or metallic traces 308. The magnetic core may also have chamfered edges providing a profile or cross section that is rounded.

Furthermore, although the embedded magnetic component device illustrated above uses conductive vias 307 to connect the upper and lower winding layers 308, it will be appreciated that in alternative preferred embodiments other connections could be used, such as conductive pins. The conductive pins could be inserted into the through holes 306 or could be pre-formed at appropriate locations in the insulating substrate 301 and first insulating layer 305.

In this description, the terms top, bottom, upper and lower are used only to define the relative positions of features of the device with respect to each other and in accordance with the orientation shown in the drawings, that is with a notional z axis extending from the bottom of the page to the top of the page. These terms are not therefore intended to indicate the necessary positions of the device features in use, or to limit the position of the features in a general sense.

Preferred Embodiment 2

A second preferred embodiment will be described with reference to FIG. 6.

In Preferred Embodiment 1, the lower winding layer of the transformer primary 410 and secondary windings 412 is formed directly on the lower side of the insulating substrate 301, and the third layer 309*b* is subsequently laminated onto the insulating substrate 301 over the lower winding layer 308.

In Preferred Embodiment 2, the structure of the device 300*a* is identical to that described in FIGS. 3A-3F, but in the step illustrated in FIG. 3D, before the through holes 306 are formed, an additional layer, fourth insulating layer 305*b*, is laminated onto the insulating substrate 301. The through holes are then formed through the substrate 301, and the first 305*a* and fourth 305*b* insulating layers, and the through holes 306 are plated to form conductive vias 307. Thus, as illustrated in FIG. 6, in this preferred embodiment, when the lower winding layer 308 is formed, in the step previously illustrated in FIG. 3F, it is formed on the fourth insulating layer 305*b*, rather than on the lower side of the insulating substrate 301.

The fourth insulating layer 305*b* provides additional insulation for the lower winding layer 308.

Preferred Embodiment 3

In addition to significantly improving the electrical insulation between the primary and secondary side windings of the transformer, the second and third insulating layers 309*a* and 309*b* define and serve as the mounting board on which additional electronic components can be mounted. This allows the insulating substrate 301 of the embedded magnetic component device to act as the PCB of more complex devices, such as power supply devices. In this regard, power supply devices may include DC-DC converters, LED driver circuits, AC-DC converters, inverters, power transformers, pulse transformers and common mode chokes, for example. Because the transformer component is embedded in the substrate 301, more board space on the PCB is available for the other components, and the size of the device can be made small.

Figure 7:
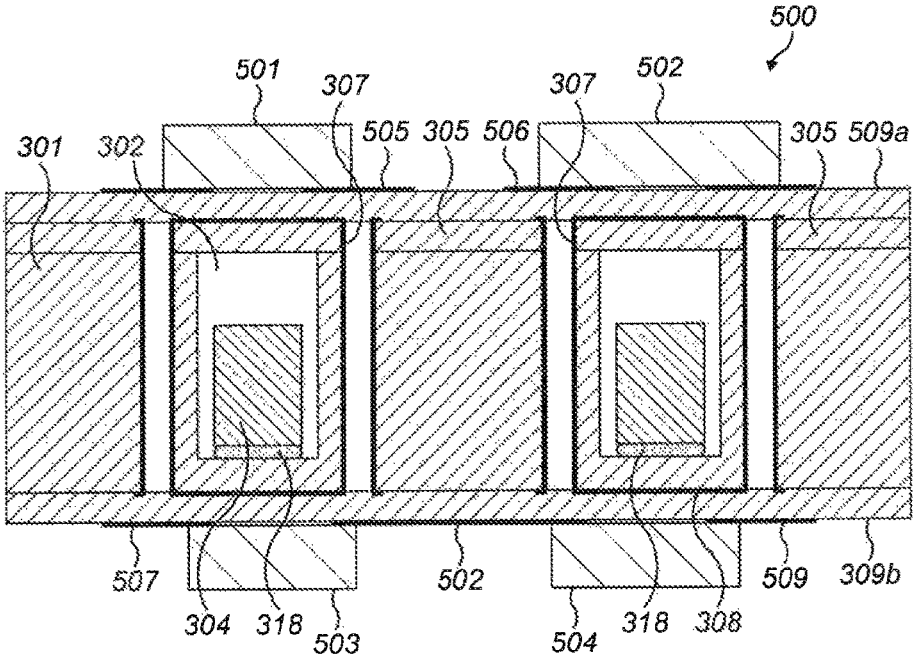
FIG. 7 illustrate a third example preferred embodiment, incorporating the embedded magnetic component device of FIG. 3F or 6 into a larger device.

A third preferred embodiment of the invention will therefore now be described with reference to FIG. 7. FIG. 7 shows example electronic components 501, 502, 503 and 504, surface mounted on the second and third insulating layers 309*a* and 309*b*. These components may include one or more resistors, capacitors, switching devices such as transistors, integrated circuits and operational amplifiers for example. Land grid array (LGA) and Ball Grid Array components may also be provided on the layers 309*a* and 309*b*.

Before the electronic components 501, 502, 503 and 504 are mounted on the mounting surface, a plurality of metallic traces are formed on the surfaces of the second and third insulating layers 309*a* and 309*b* to make suitable electrical connections with the components. The metallic traces 505, 506, 507, 508 and 509 are formed in suitable positions for the desired circuit configuration of the device. The electronic components can then be surface mounted on the device and secured in place by reflow soldering, for example. One or more of the surface mounted components 501, 502, 503 and 504 preferably connects to the primary windings 410 of the transformer, while one or more further components 501, 502, 503 and 504 preferably connects to the secondary windings 420 of the transformer.

Figure 6:
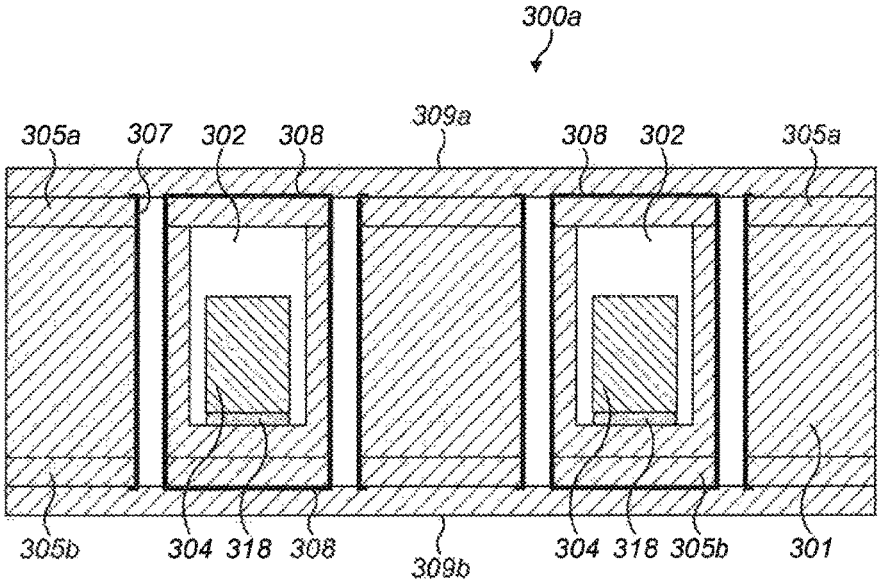
FIG. 6 illustrates a second preferred embodiment of the device.

The resulting power supply device 500 shown in FIG. 7 may be constructed based on the embedded magnetic component devices 300 and 300*a* shown in FIG. 3F or 6 for example.

Preferred Embodiment 4

Figure 8:
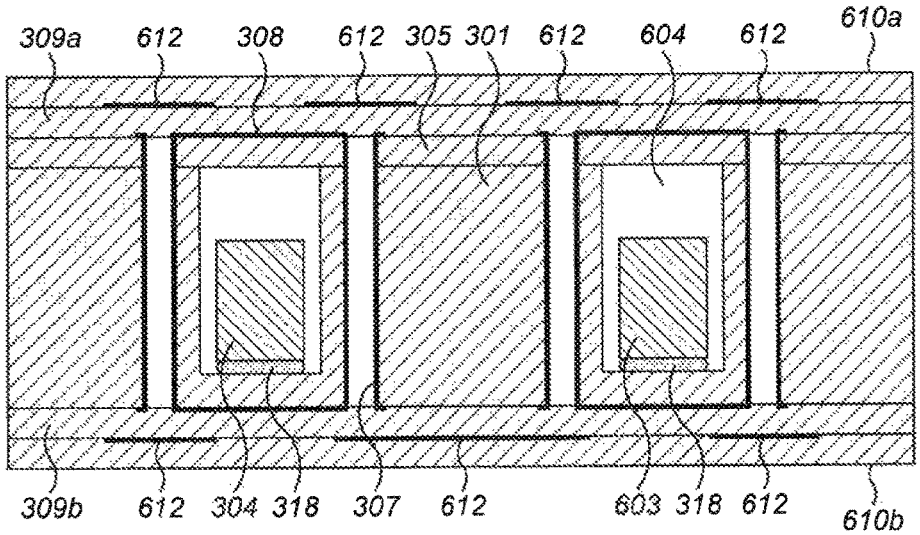
FIG. 8 illustrates a fourth example preferred embodiment including further layers of insulating material.

A further preferred embodiment will now be described with reference to FIG. 8. The embedded magnetic component of FIG. 8 is identical to that of FIGS. 3F and 6 except that further insulating layers are provided on the device. In FIG. 8, for example, additional metallic traces 612 are formed on the second and third insulating layers 309*a* and 309*b*, and additional insulating layers 610*a* and 610*b* are then formed on the metallic traces 612. As before, the fifth and sixth insulating layers 610*a* and 610*b*, can be secured to the second and third layers 309*a* and 309*b* by lamination or adhesive.

The additional layers 610*a* and 610*b* provide additional depth in which circuit lines can be constructed. For example, the metallic traces 612 can be an additional layer of metallic traces to metallic traces 505, 506, 507, 508 and 509, allowing more complicated circuit patterns to be formed. Metallic traces on the outer surface 505, 506, 507, 508 and 509 can be taken into the inner layers 610*a* and 610*b* of the device and back from it, using conductive vias. The metallic traces can then cross under metallic traces appearing on the surface without interference. Interlayers 510*a* and 510*b* therefore allow extra tracking for the PCB design to aid thermal performance, or more complex PCB designs. The device shown in FIG. 8, may therefore advantageously be used with the surface mounting components 501, 502, 503 and 504 shown in FIG. 7.

Alternatively, or in addition, the metallic traces of the fifth and sixth additional insulating layers 610*a* and 610*b* may be used to provide additional winding layers for the primary and secondary transformer windings. In the examples discussed above, the upper and lower windings 308 are formed on a single level. By forming the upper and lower winding layers 308 on more than one layer, it is possible to put the metallic traces of one layer in an overlapping position with another layer. This means that it is more straightforward to take the metallic traces to conductive vias in the interior section of the magnetic core, and potentially more conductive vias are able to be incorporated into the device.

Only one of two additional insulating layers 610*a* or 610*b* may be necessary in practice. Alternatively, more than one additional insulating layer 610*a* or 610*b* may be provided on the upper or lower side of the device. The additional insulating layers 610*a* and 610*b* may be used with any of the devices illustrated in Preferred Embodiments 1, 2 or 3.

In all of the devices described, an optional solder resist cover may be added to the exterior surfaces of the device, either the second and third insulating layers 309*a* and 309*b*, or the fifth and sixth insulating layers 310*a* and 310*b*.

Example preferred embodiments of the present invention have been described for the purposes of illustration only. These are not intended to limit the scope of protection as defined by the attached claims. It will be appreciated that features of one preferred embodiment may be used together with features of another preferred embodiment.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An embedded magnetic component comprising:

a base insulating substrate including opposing first side and second side, and including a cavity therein, the cavity including a cavity floor, and cavity side walls being connected by the cavity floor;

a magnetic core housed in the cavity;

an insulating layer located on the base insulating substrate and covering the magnetic core and the cavity so as to define an insulated substrate;

one or more electrical windings, passing through at least the insulated substrate adjacent the cavity and disposed around the magnetic core; and one or more discrete adhesive coated attachment points which adhere the magnetic core in the cavity; wherein the cavity is larger than the magnetic core such that an air gap is provided between the magnetic core and the cavity side walls, and/or between the magnetic core and the insulating layer;

no discrete adhesive coated attachment point included in the embedded magnetic component is located at a position other than a portion of the cavity floor or a portion of the magnetic core; and no discrete adhesive coated attachment point included in the embedded magnetic component contacts the cavity side walls.

2. The component of claim 1, wherein the one or more discrete adhesive coated attachment points are located on the cavity floor only.

3. The component of claim 2, wherein the cavity and the magnetic core are toroidal and the one or more discrete adhesive coated attachment points are positioned only at a discrete location or discrete locations spaced around the toroid on the cavity floor.

4. The component of claim 2, further comprising a channel connecting the cavity to an exterior of the insulated substrate, the channel including a channel floor connecting to the cavity floor.

5. The component of claim 4, wherein at least one of the one or more discrete adhesive coated attachment points is located at an intersection where the channel meets the cavity.

6. The component of claim 2, further comprising:

a first channel and a second channel connecting the cavity to an exterior of the insulated substrate, the first and second channels including channel floors connected to the cavity floor, and located on opposite sides of the cavity; wherein the one or more discrete adhesive coated attachment points include:

a first adhesive coated attachment point located at an intersection where the first channel meets the cavity;

a second adhesive coated attachment point located at an intersection where the second channel meets the cavity; and third and/or fourth adhesive coated attachment points located in the cavity at respective locations intermediate of the intersections where the first and second channels meet the cavity.

7. The component of claim 6, wherein the cavity has a circumference and the one or more adhesive coated attachment points are spaced apart from one another equally or substantially equally around the circumference of the cavity.

8. The component of claim 7, wherein the one or more discrete adhesive coated attachment points are located in a non-contacting relationship to the electrical windings.

9. The component of claim 8, further comprising an additional insulating layer located on the base insulating substrate opposite to the insulating layer.

10. The component of claim 1, further comprising an electronic component mounted on the insulated substrate.

11. The component of claim 1, further comprising a trace on or in the insulated substrate.

12. The component of claim 1, further comprising a first isolation barrier that includes a resin material that is not a solder resist, that includes a plurality of layers, that covers a first side of the insulated substrate, and that provides a solid bonded joint with the first side of the insulated substrate.

13. The component of claim 12, further comprising a second isolation barrier that includes a resin material that is not a solder resist, that includes a plurality of layers, that covers a second side of the insulated substrate, and that provides a solid bonded joint with the second side of the insulated substrate.

* * * * *